US010364003B2

(12) United States Patent
Hargrave et al.

(10) Patent No.: US 10,364,003 B2
(45) Date of Patent: Jul. 30, 2019

(54) HYBRID FIXED/FLOATING MARINE STRUCTURES

(71) Applicant: CMI LIMITED CO., Marietta, GA (US)

(72) Inventors: Steve Hargrave, Roswell, GA (US); Charles Brown, Atlanta, GA (US); Allen Jason Nail, Deltona, FL (US)

(73) Assignee: CMI LIMITED CO., Marietta, GA (US)

( * ) Notice: Subject to any disclaimer, the term of this patent is extended or adjusted under 35 U.S.C. 154(b) by 0 days.

(21) Appl. No.: 15/596,874

(22) Filed: May 16, 2017

(65) Prior Publication Data

US 2017/0334530 A1 Nov. 23, 2017

Related U.S. Application Data

(60) Provisional application No. 62/337,425, filed on May 17, 2016.

(51) Int. Cl.

| | |
|---|---|
| ***E02D 35/00*** | (2006.01) |
| ***B63B 35/34*** | (2006.01) |
| ***B63B 35/38*** | (2006.01) |
| ***E01D 15/14*** | (2006.01) |
| ***B63C 1/02*** | (2006.01) |
| ***E02D 5/22*** | (2006.01) |

(52) U.S. Cl.
CPC ..... *B63C 1/02* (2013.01); *E02D 5/22* (2013.01); *E02D 35/005* (2013.01)

(58) Field of Classification Search
CPC ... B63B 35/34; B63B 35/38; B63B 2021/504; B63B 2737/00; B63C 1/02; E02B 17/0017; E02D 5/226; E02D 5/60
USPC ... 114/263, 230.1, 266, 267, 230.11–230.18, 114/230.27, 230.28; 405/219, 221, 211, 405/216, 217, 218, 61; 248/65, 67.5, 70, 248/74.4; 441/3
See application file for complete search history.

(56) References Cited

U.S. PATENT DOCUMENTS 2,348,160 A * 5/1944 Thornhill ..... B64C 25/60 188/317
2,387,844 A * 10/1945 Harris ..... B63C 5/04 114/45
2,390,300 A * 12/1945 Harris ..... B63C 5/04 114/259
3,131,542 A * 5/1964 Koch ..... E02B 3/064 114/266

(Continued)

FOREIGN PATENT DOCUMENTS

JP 1019585 A * 7/1998

OTHER PUBLICATIONS

Bellingham Marine Blog; "Telescoping Pile: An Innovation in Marina Dock Design"; RComstock; Jun. 29, 2012; 2 pgs.

*Primary Examiner* — Benjamin F Fiorello
*Assistant Examiner* — Edwin J Toledo-Duran
(74) *Attorney, Agent, or Firm* — Gardner Groff Greenwald & Villanueva, PC

(57) ABSTRACT

A marine structure including a floating deck attached to a damper configured to control the vertical movement of the deck. The damper allows vertical motion of the floating deck in response to gradual changes in water level such as tidal changes, but resists bouncing of the deck in response to shorter term fluctuations in water level such as boat wakes or wind chop.

8 Claims, 9 Drawing Sheets

(56) References Cited

U.S. PATENT DOCUMENTS

| | | | | |
|---|---|---|---|---|
| 3,365,033 | A * | 1/1968 | Willich | F16F 9/46 188/282.5 |
| 4,158,516 | A * | 6/1979 | Noblanc | E02B 17/025 405/196 |
| 6,050,207 | A * | 4/2000 | Mays | E02D 27/00 114/45 |
| 7,563,056 | B2 | 7/2009 | Gambill | |
| 8,629,571 | B2 * | 1/2014 | Cotto-Rodriguez | F03B 13/06 290/53 |
| 2009/0250934 | A1 * | 10/2009 | Bozano | F03B 13/145 290/53 |
| 2012/0321387 | A1 * | 12/2012 | del Campo y Ruiz de Almodovar | B63C 3/06 405/1 |
| 2017/0234457 | A1 * | 8/2017 | Sayler | F16L 1/06 248/49 |
| 2017/0350083 | A1 * | 12/2017 | Fuhrmann | B63B 21/00 |

* cited by examiner

HYBRID FIXED/FLOATING MARINE STRUCTURES

CROSS-REFERENCE TO RELATED APPLICATION

This application claims priority to U.S. Provisional Patent Application Ser. No. 62/337,425 filed May 17, 2016, which is hereby incorporated herein by reference in its entirety.

TECHNICAL FIELD

The present invention relates generally to the field of marine structures, and more particularly to a hybrid fixed/floating dock or other marine structure incorporating a damper for resisting high-frequency bouncing but following gradual changes in water level.

BACKGROUND

In some bodies of water, the water level can fluctuate between a high water mark and a low water mark multiple times per day due to the tides. Water levels can also fluctuate in non-tidal bodies of water, for example in power generating lakes where water may be drawn down for hydro-electric power generation at higher usage times, or seasonally. Tidal or other water level changes can have an amplitude of over six feet and a wavelength of a little over twelve hours. In these areas a dock at a fixed height can be impractical for many applications. A fixed dock results in a large vertical distance between the deck and the water surface at low tide. Boats tied off to a fixed dock may need to be continuously retied as the tide changes. Therefore, docks often employ a floating marine structure designed to change vertical position as the water level rises and falls.

Previously known floating marine structures, or floating docks, include a buoyant horizontal deck that is secured to the shore or a fixed structure, for example by a hinged walkway or pier. The deck is secured in a way that allows it float on the water surface and move freely in a vertical direction as the water level changes. However, in addition to more gradual longer-term and/or larger-scale water level changes such as tidal changes, the water level is also subject to sudden shorter-term fluctuations. Passing boats create wakes and wind or other weather can create chop. These conditions create waves of a smaller amplitude than the tides, but also of a much smaller wavelength and/or higher frequency, often lasting only a few seconds. These smaller, but sharper waves can cause damage to the floating dock and objects secured to it when the floating dock is allowed to move freely. Sudden changes in the floating dock's vertical position can also compromise the comfort and safety of persons on the dock.

Accordingly, it can be seen that needs exist for a floating marine structure capable of adjusting vertical position when subject to large, gradual changes in water level, but remaining relatively stable in a fixed vertical position when subjected to smaller waves. It is to the provision of a hybrid fixed/floating dock or other marine structure meeting these and other needs that the present invention is primarily directed.

SUMMARY

In example embodiments, the present invention provides a hybrid fixed/floating dock, pier, boat slip, swim platform or other marine structure that is able to move up and down with the larger more gradual water level changes, for example as associated with tides or daily/seasonal water level changes controlled by hydroelectric dams, but which remains relatively stable and fixed in vertical position when subject to smaller waves such as wakes from boats or wind-induced chop.

In one aspect, the invention relates to a marine structure including a buoyant deck configured to float on a body of liquid defining a liquid surface, and at least one hydraulic damper in operative engagement with the buoyant deck. The liquid surface defines a variable level and is subject to longer-term variation between an upper level and a lower level. The liquid surface is also subject to shorter-term fluctuations in level. The at least one hydraulic damper is preferably configured to allow the buoyant deck to move up and down in response to the longer-term variation of the liquid surface level, but to resist movement of the buoyant deck in response to the shorter-term fluctuations in level.

In another aspect, the invention relates to a hydraulic damper for a marine structure comprising a buoyant body. The damper includes a fixed housing defining an interior chamber filled with liquid and a piston head positioned within the interior chamber. The piston head has a first face, a second face, and an outer periphery. The outer periphery of the piston head abuts an interior wall of the fixed housing to form a substantially water tight seal. The damper also includes a piston rod coupled at a first end to the piston head and at a second end to the buoyant deck of the marine structure.

In still another aspect, the present invention relates to a floating dock comprising a platform having sufficient buoyancy to float in a body of water, and a dampening mechanism allowing vertical movement of the platform in response to gradual changes in water level, but resisting vertical movement of the platform in response to short-duration changes in water level.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of preferred embodiments of the invention, and are not restrictive of the invention, as claimed.

DETAILED DESCRIPTION OF EXAMPLE EMBODIMENTS

Figure 1:
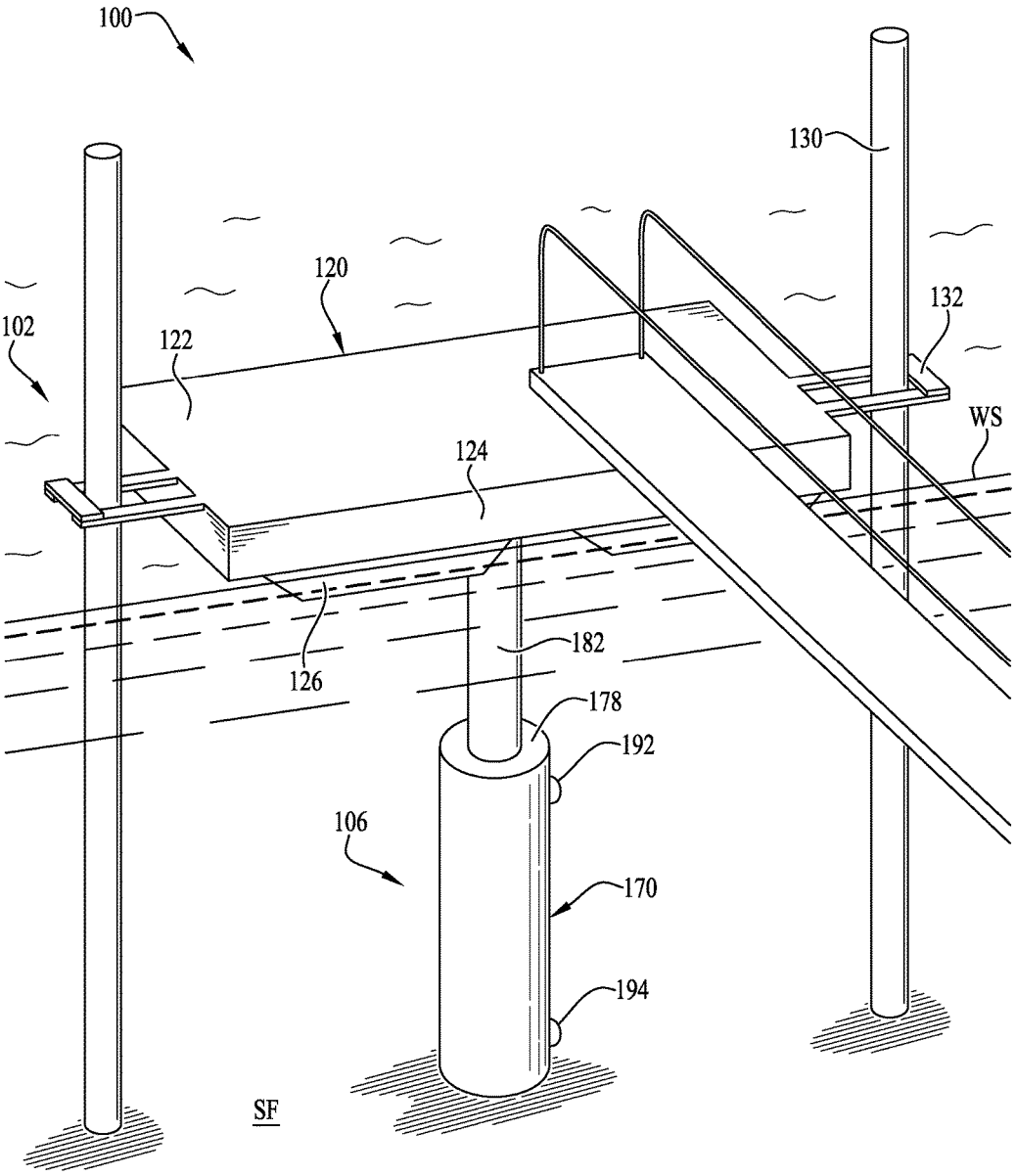
FIG. 1 is a perspective view of a hybrid fixed/floating marine structure according to an example embodiment of the present invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a hybrid fixed/floating marine structure in the form of a dock 100, according to an example embodiment of the present invention. In various embodiments of the invention, the marine structure can take the form of a dock, a pier, a boat slip, a swim platform or other type of marine structure. The hybrid fixed/floating dock 100 includes a floating marine structure 102 and a hydraulic or otherwise actuated damper 106. The floating marine structure 102 is configured to remain generally stationary in a horizontal plane defined by the water surface WS and be capable of moving in a vertical direction with changes in the level of the water surface WS. The hydraulic damper 106 is configured to control the vertical movement of the floating marine structure 102. Preferably, the dampening mechanism 106 allows the marine structure 102 to move up and down with larger, gradual changes in water level, but maintains stability of the dock when subject to wakes, chop or other short-term fluctuations of water level. For example, the damper 106 allows a range of vertical motion of at least several inches, and optionally at least several feet, for example about six feet; and allows vertical motion of the dock up or down in response to changes in water level at a rate of less than about 10-12 inches per minute. The damper 106 preferably maintains the dock 102 in a generally stable vertical position in response to higher frequency (quicker) changes in water level such as waves from boat wakes or wind chop, but allows smooth vertical movement in response to lower frequency (more gradual) water level changes such as tidal changes. For example, the damper 106 may resist movement in response to wave frequencies faster than 20 cycles per minute (0.33 Hz), and allow movement in response to slower wave frequencies. The range and rate of elevation adjustment can optionally be selectively configured depending on anticipated local conditions where the marine structure is to be installed, such as tidal changes.

The floating marine structure 102, as shown in FIG. 1, generally includes a buoyant body such as a platform or deck 120 coupled to one or more pilings 130. The deck 120 is configured to float on the surface of the water WS. The deck 120 includes a deck frame 124 and a deck surface 122. The deck frame 124 defines the area of the deck 120. The deck surface 122 is attached to the top of the deck frame 124. The deck 120 can be formed of wood, plastic, rubber, concrete or any other material or combination of materials suitable for forming a generally buoyant and stable horizontal surface. The deck 120 can further include one or more pontoons or other float units 126 to provide buoyancy. In the example embodiments, the float units 126 are attached the deck within the deck frame 124 and underneath the deck surface 122 such that they are suspended between the deck surface and the water surface WS. The float units 126 can be formed of foam material, buoyant hollow plastic structures, wood, aluminum pontoons, or any other structure or material suitable to help the deck 120 float on the surface of the water WS.

To hold the deck 120 in a generally fixed horizontal position, the deck is coupled to one or more pilings 130. In the example embodiment, the pilings 130 comprise vertical columns and can be formed of wood, concrete, steel, etc. Each piling 130 is attached at its proximal end to the sea floor SF, lake bed or other anchoring point. In preferred embodiments, the pilings 130 are a length such that the piling's distal end is above the water surface WS at the high water mark. In the example embodiments, the pilings 130 are positioned around the outer periphery of the deck 120. The pilings 130 are attached to the deck 102 using one or more couplings 132. In the depicted embodiment, the couplings 132 are attached to the outer surface of the deck frame 124 and extend around the piling 130. The couplings 132 are configured to limit the movement of the marine structure 102 in a horizontal plane, but allow the deck 120 to move up and down generally unencumbered. In example embodiments, the couplings 132 comprise rings configured to loop around the pilings 132. In alternate embodiments, the couplings 132 can be formed from rails, sliders or other retention members for retaining the deck 120 in a generally fixed position in the horizontal plane, but allow the deck to move up and down in response to changes in the water level WS. The floating marine structure 102 is sufficiently buoyant such that the deck 120 will float on the water and change vertical position with changes in the water level WS. In alternate embodiments, alternative structures can be used to hold the marine structure 102 in a fixed horizontal position while allowing the marine structure to move up and down with changes in water levels.

Figure 2:
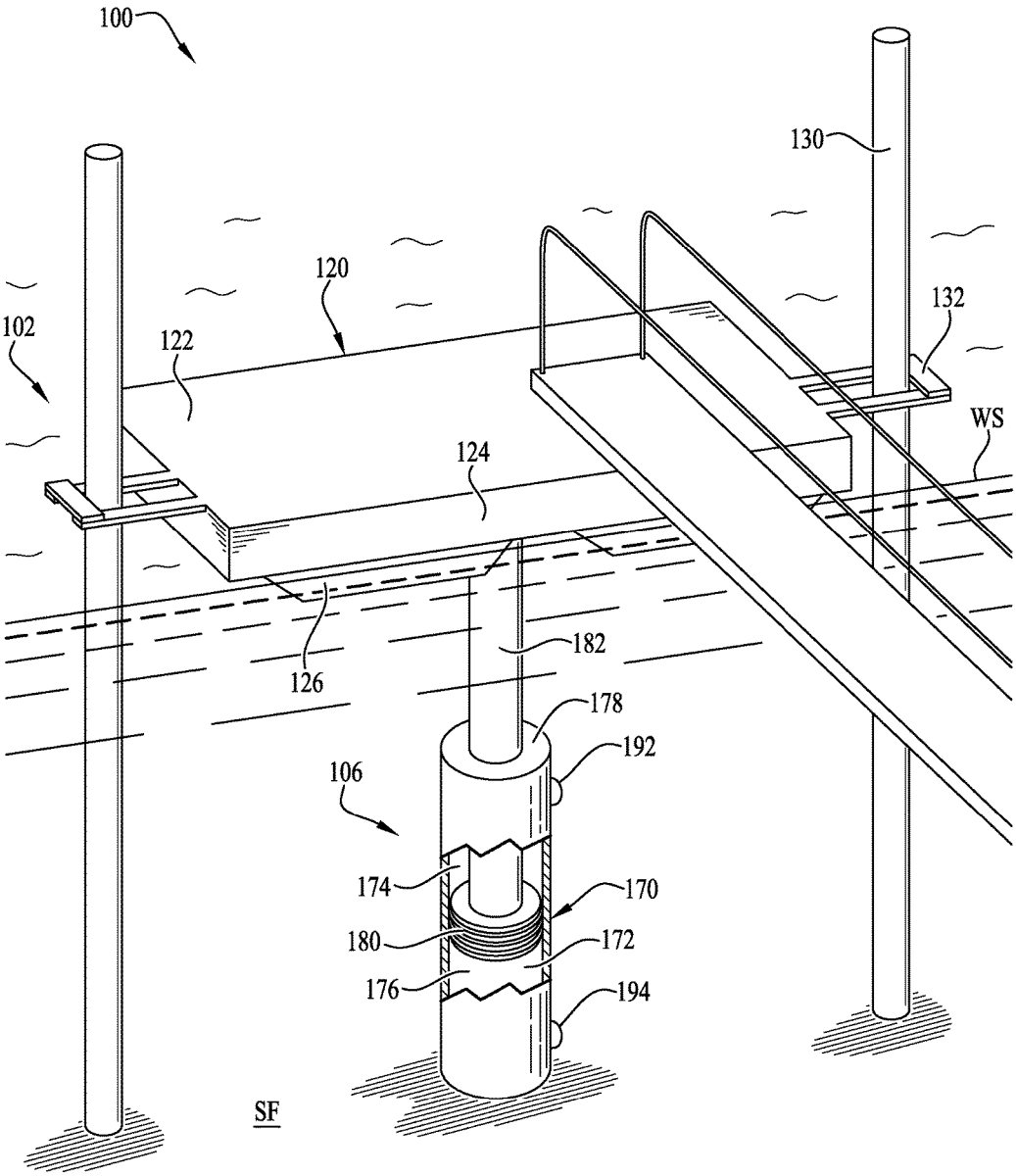
FIG. 2 is a perspective view of the hybrid fixed/floating marine structure of FIG. 1, with a cut away view of the hydraulic damper.
Figure 3:
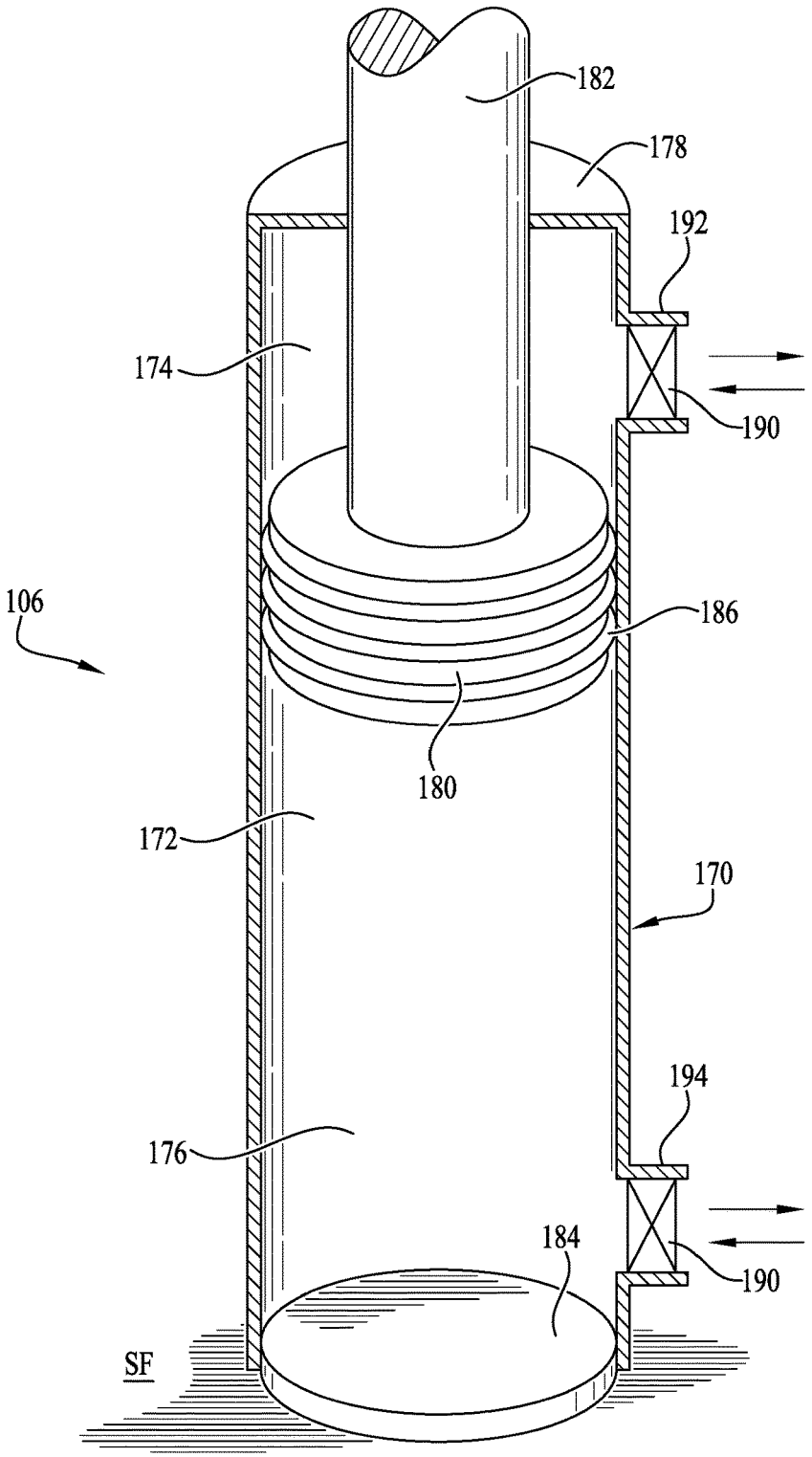
FIG. 3 is a detailed perspective view of the hydraulic damper of the hybrid fixed/floating marine structure of FIG. 1.

The hydraulic damper 106, shown in detail in FIGS. 2 and 3, includes a fixed housing 170 containing a piston head 180 attached to a piston shaft 182. In the example embodiments, the fixed housing 170 is a cylindrical shape having an inner configuration sized and shaped to generally match an outer periphery or cross section of the piston head 180. In alternate embodiments, the fixed housing 170 and piston head 180 can have a non-cylindrical cross section. The housing 170 is attached at its proximal end to the sea floor SF, lake bed, or other fixed surface or structure, and extends vertically toward the water surface WS. The housing 170 is positioned beneath the deck 120 of the floating marine structure 102. The interior surface of the housing 170 creates a chamber 172 configured to contain fluid and receive the piston head 180 attached to the piston rod or shaft 182 as described below. The housing 170 can be formed from metal, polymer or a composite material. The distal end of the fixed housing 170 includes a cap 178 configured to allow the piston shaft 182 to move in a generally vertical direction. The cap 178 is further configured to keep the piston head 180 and fluid within the chamber. The damper 106 can also include a seal 184 positioned at the distal end of the chamber 172 of the housing 170. The seal 184 is configured to prevent soil or other contaminates from entering the chamber 172 after the housing 170 is installed in the sea floor SF. The seal 184 is positioned between the piston head 180 and the proximal or bottom end of the chamber 172. In alternative embodiments, the orientation can be reversed, with a movable chamber or housing attached to the deck and moving up and down along a fixed piston member attached to the sea floor.

As shown in FIG. 2, the piston rod 182 is mounted at its proximal end to the floating marine structure 102. In the example embodiment, the proximal end of the piston rod 182 is mounted to the underside of the deck surface 122 at a position above the fixed housing 170. The piston rod 182 extends downward in a vertical direction, perpendicular to the deck surface 122. The distal end of the piston rod 182 includes a piston head 180. The distal end of the piston rod 182 and the piston head 180 are received within the fixed housing 170. In the depicted embodiment, the piston head 180 has a substantially circular disc shape with a proximal face attached to the piston rod 182 and an opposing distal face creating a peripheral sidewall therebetween. In alternate embodiments, the piston can be square, rectangular, polygonal or otherwise shaped. The piston head 180 is sized such that the diameter of the peripheral sidewall is approximately equal to or slightly smaller than the diameter of the interior surface of the fixed housing 170, to form a close fit but allow the piston to slide up and down within the housing. The piston head 180 is configured to create a substantially water tight seal between the piston's peripheral sidewall and the interior surface of the housing 170. The piston head 180 can include one or more ridges or gaskets 186 around the peripheral sidewall. The ridges 186 can be formed from a deformable material that is compressed between the peripheral sidewall of the piston head 180 and the inner surface of the housing 170. The ridges 186 can help the piston head 180 form a substantially water tight seal between the peripheral sidewall and the interior surface of the housing 170. The piston head 180 is configured to divide the housing chamber 172 into two substantially water tight sections. The upper section 174 is bound between the cap 178 and the proximal face of the piston head 180. The lower section 176 is bound between the distal face of the piston head 180 and the bottom of the fixed housing 170.

As shown in FIG. 3, the fixed housing 170 includes two ports 192, 194. The first port 192 allows water to flow in and out of the upper chamber section 174 and the second port 194 allows water to flow in and out of the lower chamber section 176. Both ports 192, 194 optionally include an adjustable two-way valve 190. The valves 190 are configured to restrict water flow until a pressure differential exists between the water in the chamber 172 and the water surrounding the fixed housing 170. When the pressure differential reaches a specified threshold level, the valve 190 will open allowing water to flow from the area of higher pressure to the area of lower pressure, either into or out of the respective chamber. The required pressure differential needed to open the valves 190 can optionally be adjusted by a user or installer to suit the intended application, for example to provide a faster or slower rate of rise and fall of the floating marine structure in response to longer-term water level changes, and/or greater or lesser resistance to shorter-term fluctuations in water level. Optionally, two or more ports can be provided for each chamber section.

Figure 4:
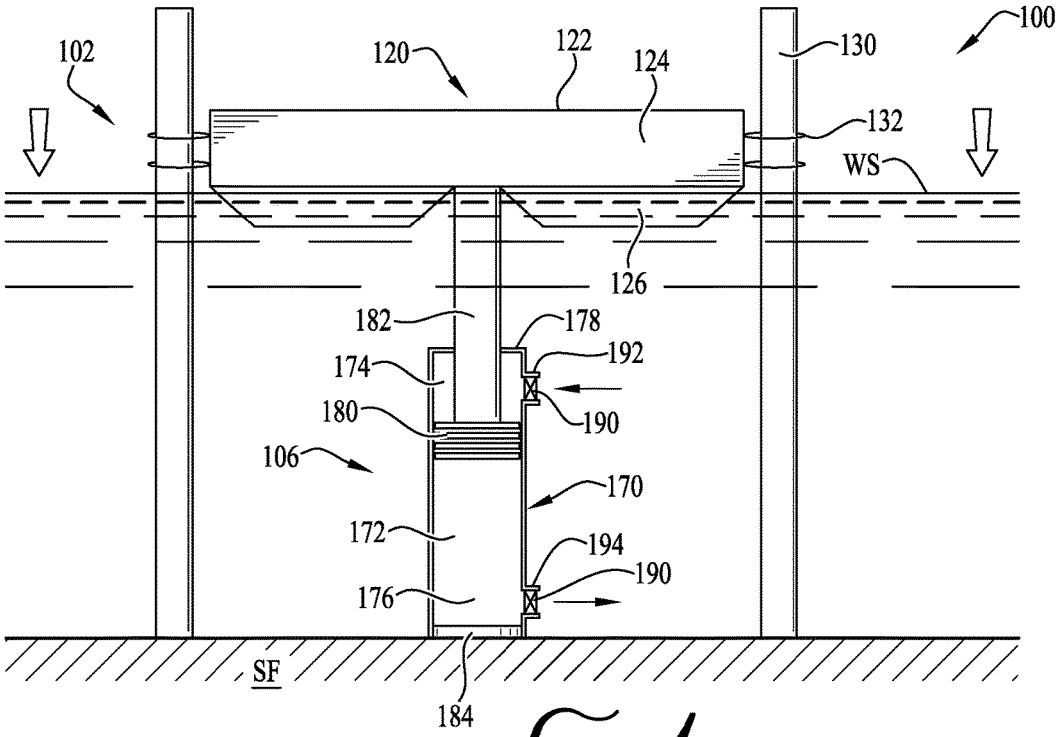
FIG. 4 is a side view of the hybrid fixed/floating marine structure of FIG. 1, in a raised position.
Figure 5:
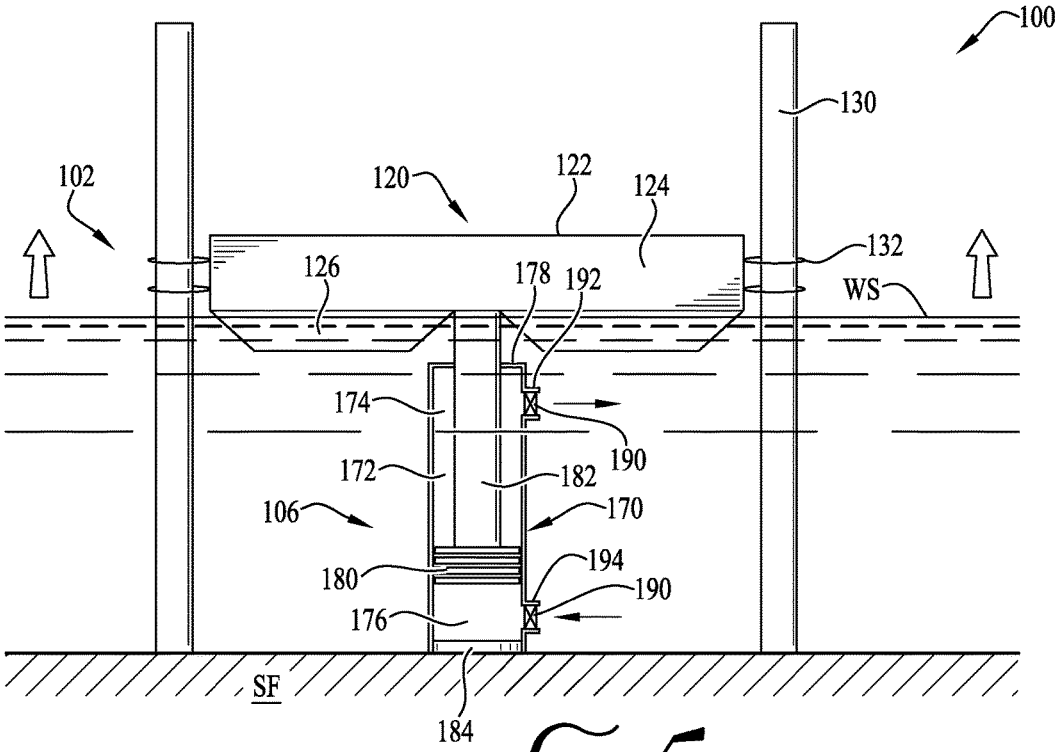
FIG. 5 is a side view of the hybrid fixed/floating marine structure of FIG. 1, in a lowered position.

FIG. 4 depicts the floating marine structure 102 and hydraulic damper 106 at an upper position, for example corresponding to the high tide water level. As the tide goes out and the water surface WS lowers, the buoyant force acting on the deck 120 decreases. As a result, the downward push force exerted by the weight of the deck 120 on the piston rod 182 and piston head 180 increases. The increased force results in increased fluid pressure in the lower section 176 of the housing chamber 172 and decreased fluid pressure in the upper section 174 of the housing chamber. When the pressure differential reaches the required level the valves 190 will open allowing sea water to flow into the upper section 174 and out of the lower section 176. As a result the piston head 180, piston rod 182, and deck 120 will move in a downward vertical direction toward the lowered position shown in FIG. 5. When the tide is incoming as shown in FIG. 5, or the water level is otherwise rising, the buoyant force acting on the deck 120 increases, resulting in an increase in the upward pull force exerted by the deck 120 on the piston rod 182 and piston head 180. This pull force increases the fluid pressure in the chamber's upper section 174 and decreases fluid pressure in the chamber's lower section 176. At the appropriate pressure differential, the valves 190 open to allow fluid to flow out of the upper section 174 and into the lower section 176, allowing the piston head 180, piston rod 182 and deck 120 to move in an upward vertical direction. Preferably, the valves 190 are adjusted such that a wave with a small wavelength, like those created by chop or a boat wake, will not create the required pressure differential to open the valves 190, and/or not open the valves for a duration sufficient to raise or lower the deck structure 120 significantly. Therefore, the deck 120 will remain at a substantially stationary vertical position when subject to waves with a short wavelength, but will rise and lower gradually with longer duration changes in water level.

Figure 6:
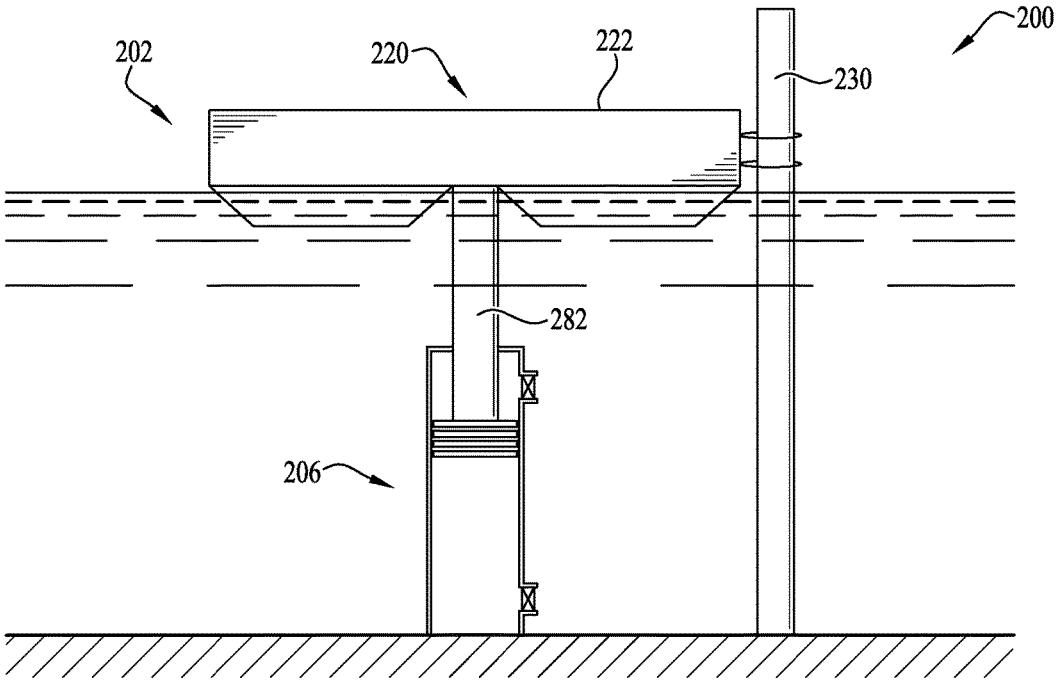
FIG. 6 is a side view of a hybrid fixed/floating marine structure according another example embodiment of the present invention.
Figure 7:
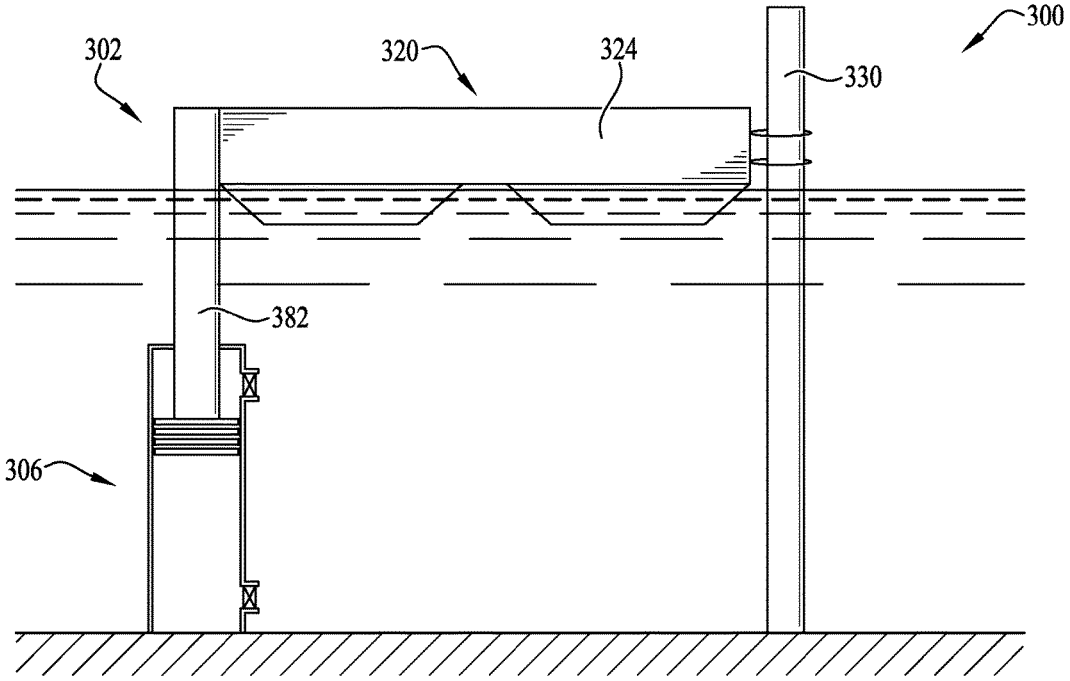
FIG. 7 is a side view of a hybrid fixed/floating marine structure according another example embodiment of the present invention.
Figure 8:
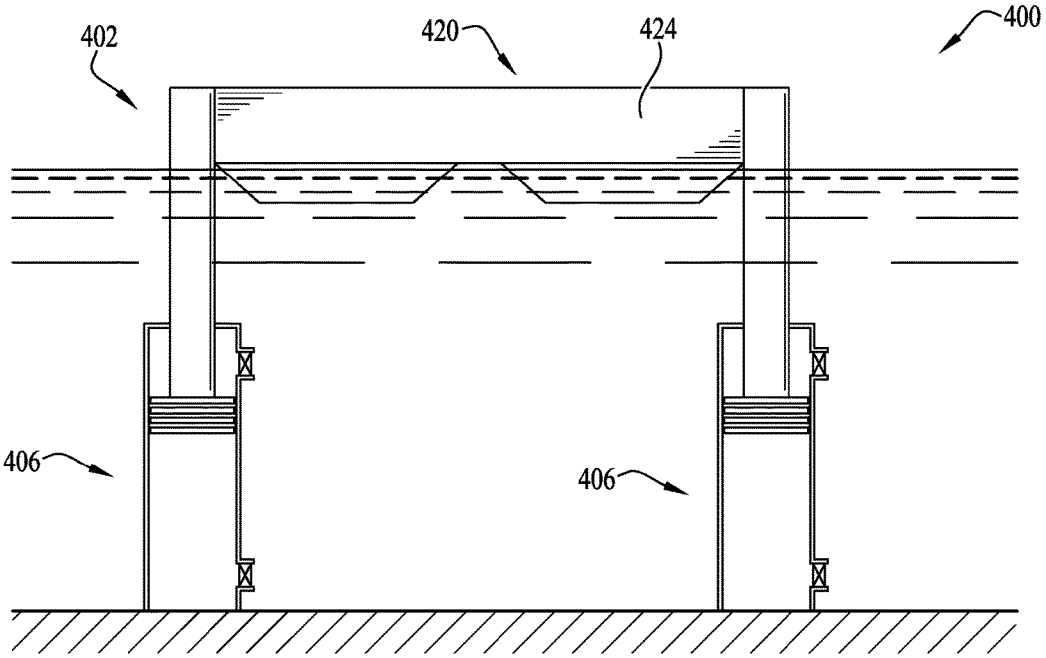
FIG. 8 is a side view of a hybrid fixed/floating marine structure according another example embodiment of the present invention.

While the example embodiments have shown a hybrid fixed/floating dock including a floating marine structure supported by a pair of fixed pilings and one hydraulic damper mounted to the underneath of the deck surface, alternate configurations of dampers and pilings can be used, for example including one, two, three, four or more pilings. For example, as shown in FIG. 6, the floating marine structure 202 can be supported by a single fixed piling 230, or fixed pilings coupled to only one side of the deck 220. As in the previous embodiments, the hydraulic damper 206 is positioned beneath the deck 220, with the piston rod 282 mounted to the underside of the deck surface 222. In alternative embodiments, as shown in FIG. 7, the floating marine structure 302 includes pilings 330 positioned as in the previous embodiment. In this embodiment, the hydraulic damper 306 is positioned on the periphery of the deck 320 with the piston rod 382 being mounted to the outside surface of the deck frame 324. In the example embodiment, the piston rod 382 is positioned on the side of the deck 320 opposite the pilings 330. In other embodiments, the floating marine structure does not include fixed pilings, but may optionally include one or more cables or other retention members for retaining the dock structure in position horizontally, but allowing the dock to move vertically with changing water level. In example embodiments, as shown in FIG. 8, the floating marine structure 402 is restricted in the horizontal plane by a series of two or more hydraulic dampers 406. In the depicted embodiment, the dampers 406 are mounted to the periphery of the deck frame 424. In alternate embodiments, the dampers 406 can be mounted to the underside of the deck 420.

Figure 9:
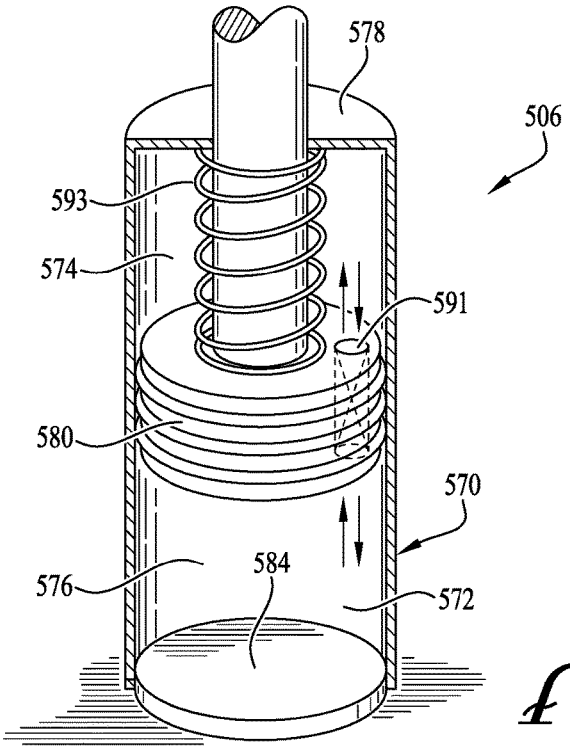
FIG. 9 is a perspective view of a hydraulic damper for a hybrid fixed/floating marine structure according to another example embodiment of the present invention.

FIG. 9 shows a hydraulic damper 506 according to another example embodiment of the invention. In this embodiment, the fixed housing 570 does not include ports allowing fluid to flow between the chamber and the surrounding body of water, as in the previous embodiments. Instead, the chamber 572 is a closed system. Because the system is closed, a fluid other than water can be used within the chamber 572. The piston 580 includes an adjustable valve or tunable orifice 591 extending between the distal face and the proximal face of the piston head. When the water level decreases as the tide goes out, as described above, a pressure differential exist between the chamber's upper section 574 and lower section 576. When the pressure differential reaches a certain level, the tunable orifice 591 allows fluid to flow through the piston head 580 from the lower section 576 to the upper section 574, which allows the deck to move to a lower vertical position. The tunable orifice 591 allows fluid to flow in the opposite direction when there is rising water level or incoming tide. This embodiment can further include a spring 593 suspended between the proximal face of the piston head 580 and the bottom of the fixed housing cap 578. The spring 593 is configured to absorb vibrations caused when the marine structure is subject to smaller high frequency waves. The tunable orifice 591 is optionally adjustable by the user or installer to control the rate of rising and lowering in response to a change in water level. The chamber 572 can also include a seal 584 positioned at the proximal end of the chamber. As in previous embodiments, the seal 584 is configured to prevent soil or other contaminates from entering the chamber 572.

Figure 10:
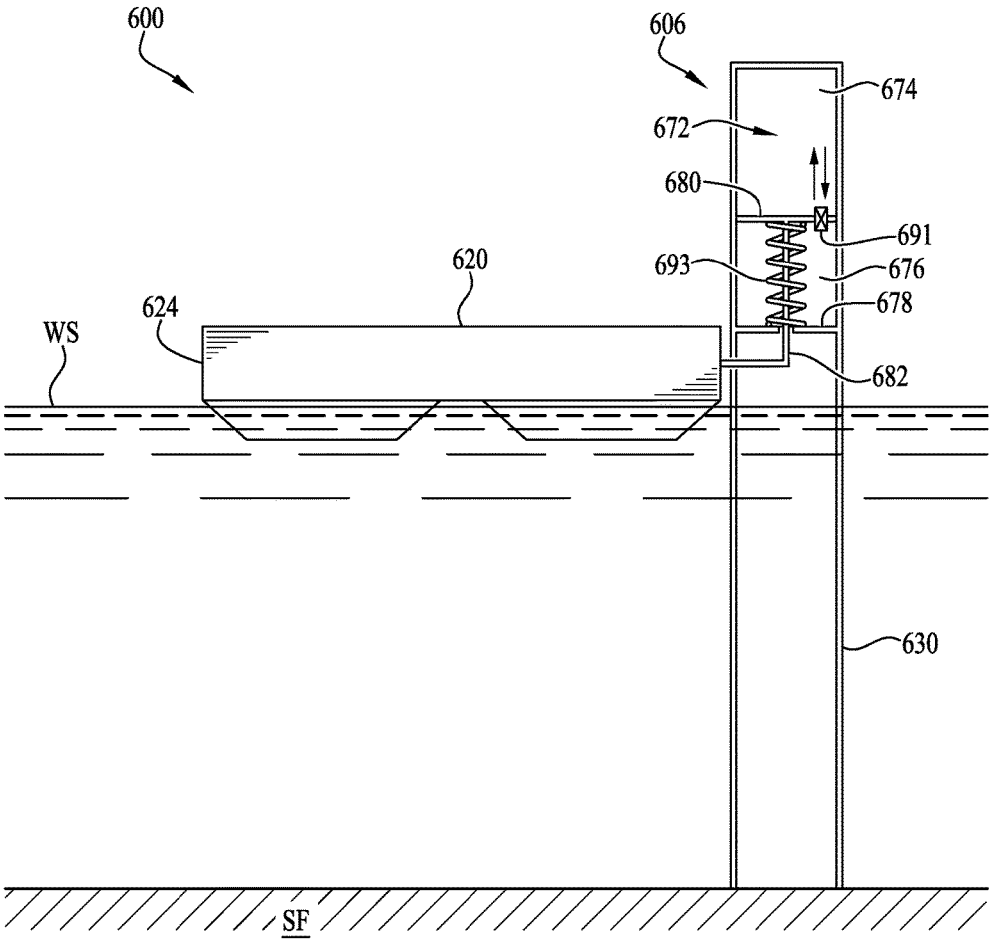
FIG. 10 is a side view of a hybrid fixed/floating marine structure according to another example embodiment of the present invention.
Figure 11:
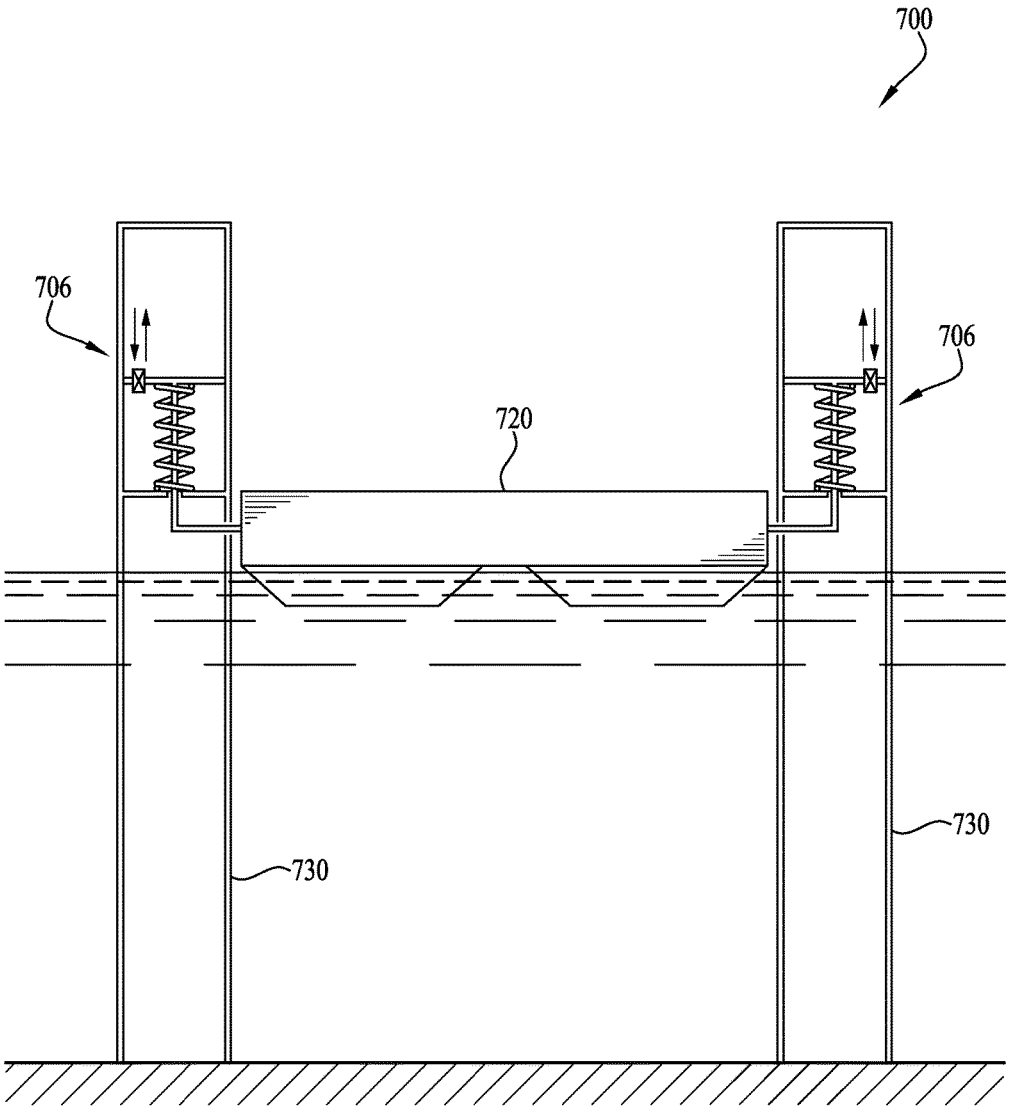
FIG. 11 is a side view of a hybrid fixed/floating marine structure according to another example embodiment of the present invention.

FIG. 10 depicts a hybrid fixed/floating dock 600 according to another example embodiment of the invention. The embodiment uses a hydraulic damper 606 similar to the damper 506 of the previous embodiment. However, the damper 606 of this embodiment is positioned within a piling 630 and is inverted from the configuration of the previous embodiment. Like in previous embodiments, the proximal end of the piling 630 is embedded in the sea floor SF and the distal end of the piling 630 extends above the water surface WS. The damper 606 is held within the distal end of the piling 630. The distal end of the piling is hollow to form a chamber 672 similar to the chamber of the previous embodiment. The chamber 672 is defined between the distal end of the piling 630 and a fixed cap 678 positioned a distance below the distal end of the piling. The chamber 672 holds a piston head 680 with a tunable orifice 691 as in the previous embodiment. The damper 606 also includes a piston rod 682 extending downward from the piston head 680 and through the cap 682. The damper can also include a spring 693 positioned between the cap 678 and the piston head 680. In the depicted embodiments, the piling 630 is positioned along the periphery of the frame 624 of the deck 620. The piston rod 682 is L-shaped to engage the deck frame 624. In alternate embodiments, the piston rod 682 can interact with an intermediary coupling that attaches to the deck 620 or deck frame 624. The piling 630 can include an opening positioned below the cap 678 that allows the piston rod 682 or intermediary coupling to extend through the piling 630 and couple with the deck 620. In alternate embodiments of the hybrid floating/fixed dock 700, a shown in FIG. 11, a plurality of pilings 730 with hydraulic dampers 706 similar to those of the previous embodiment can be used to support a deck 720.

Figure 12:
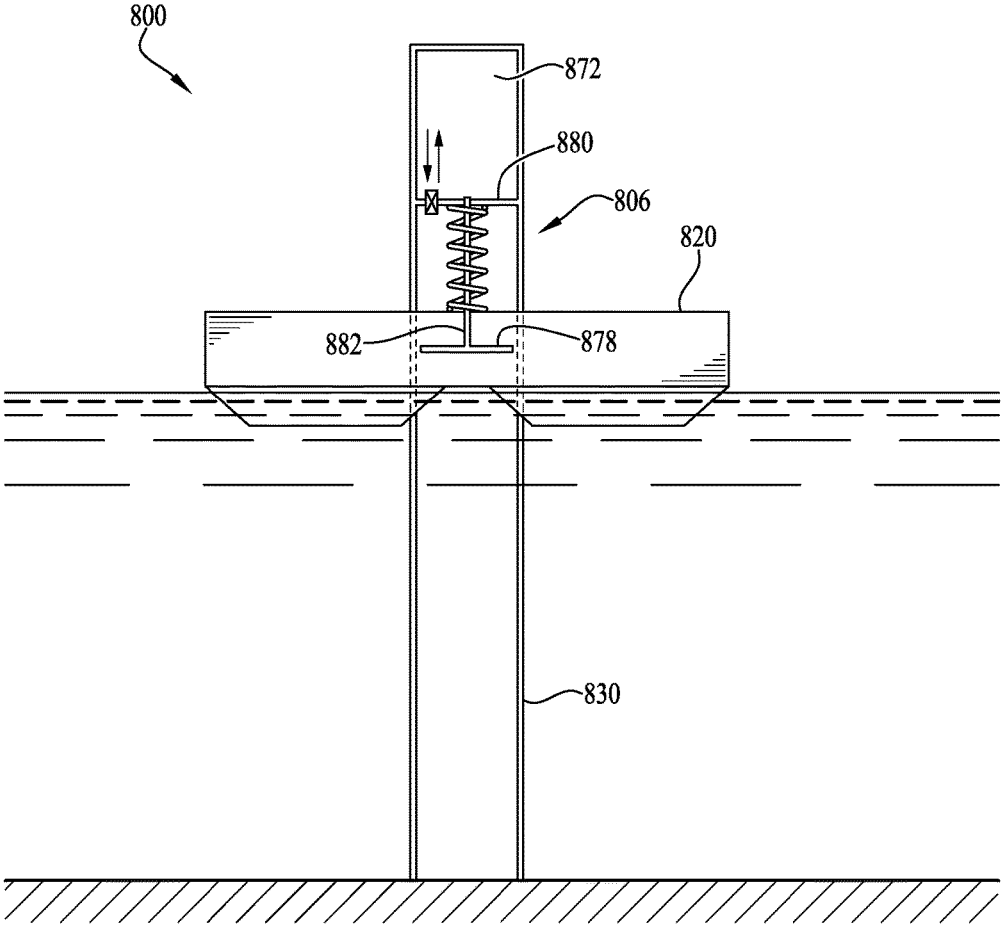
FIG. 12 is a side view of a hybrid fixed/floating marine structure according to another example embodiment of the present invention.

FIG. 12 depicts a hybrid fixed/floating dock 800 according to another example embodiment of the invention. The embodiment 800 uses a piling 830 with an embedded damper 806 similar to those of the previous embodiments. In this embodiment, the piling 830 extends through the deck structure 820. The damper 806 differs from the previous embodiments in that the piston rod 882 couples the piston head 880 to the cap 878 and the cap is able to move vertically within the piling 830. The deck is coupled to the cap 878 such that the deck moves up and down with the movement of the cap. In alternate embodiments, the piston rod 882 extends through the cap 878, as in previous embodiments, and the distal end of the piston rod couples to the deck 820 such that the deck moves up and down with the movement of the piston head 880.

While the invention has been primarily described above with reference to the sea floor and sea water, the present invention can be used in any man-made or naturally occurring body of fluid, for example, lakes, rivers, reservoirs, ponds, pools, or the like. While the invention has been described with reference to preferred and example embodiments, it will be understood by those skilled in the art that a variety of modifications, additions and deletions are within the scope of the invention, as defined by the following claims.

What is claimed is:

1. A marine structure comprising:

a buoyant deck configured to float on a body of liquid defining a liquid surface, the liquid surface defining a variable level and being subject to longer-term variation between an upper level and a lower level, the liquid surface also being subject to shorter-term fluctuations in level; and at least one hydraulic damper in operative engagement with the buoyant deck, the at least one hydraulic damper configured to allow the buoyant deck to move up and down in response to the longer-term variation of the liquid surface level, but to resist movement of the buoyant deck in response to the shorter-term fluctuations in level;

wherein a portion of the at least one hydraulic damper is submerged in the body of liquid; and wherein the at least one hydraulic damper receives liquid from and expels liquid to the body of liquid; and further comprising at least one piling, wherein the buoyant deck is coupled to the piling to retain the buoyant deck in fixed position horizontally and allow movement of the buoyant deck vertically relative to the piling, and wherein the at least one hydraulic damper is positioned within the at least one piling.

2. The marine structure of claim 1, wherein the at least one hydraulic damper is positioned below the buoyant deck.

3. The marine structure of claim 1, wherein the at least one hydraulic damper comprises a fixed housing defining an interior chamber, a piston head movable in the chamber, and a piston rod connected between the piston head and the buoyant deck.

4. The marine structure of claim 3, wherein the proximal end of the fixed housing is coupled to a support surface below the buoyant deck.

5. The marine structure of claim 3, wherein the proximal end of the piston rod is coupled to the buoyant deck and the distal end of the piston rod extends through the top of the fixed housing and couples with the piston head.

6. The marine structure of claim 4, wherein the hydraulic damper further comprises a seal positioned in the chamber between proximal end of the chamber and the piston head.

7. The marine structure of claim 3, wherein the piston head is configured to move within the chamber as the level of the water surface changes.

8. The marine structure of claim 7, wherein the hydraulic damper further comprises at least one valve configured to control the rate of movement of the piston head relative to the change in water surface level.

* * * * *